US008829261B2

(12) United States Patent
Cho et al.

(10) Patent No.: US 8,829,261 B2
(45) Date of Patent: Sep. 9, 2014

(54) METHOD OF TREATING RADIOACTIVE METAL WASTE USING MELT DECONTAMINATION

(71) Applicant: Kepco Nuclear Fuel Co., Ltd., Daejeon (KR)

(72) Inventors: Suk Ju Cho, Daejeon (KR); Young Bae Lee, Daejeon (KR); Jeung Gun Seol, Daejeon (KR); Yong Jae Kim, Daejeon (KR); Wook Jin Han, Daejeon (KR); Jae Bong Ryu, Daejeon (KR); Hyun Gyu Kang, Daejeon (KR)

(73) Assignee: Kepco Nuclear Fuel Co., Ltd., Daejeon (KR)

( * ) Notice: Subject to any disclaimer, the term of this patent is extended or adjusted under 35 U.S.C. 154(b) by 171 days.

(21) Appl. No.: 13/871,037

(22) Filed: Apr. 26, 2013

(65) Prior Publication Data

US 2013/0296629 A1 Nov. 7, 2013

(30) Foreign Application Priority Data

May 3, 2012 (KR) ..... 10-2012-0046979

(51) Int. Cl.
*G21F 9/16* (2006.01)
*G21F 9/30* (2006.01)

(52) U.S. Cl.
CPC ..... *G21F 9/308* (2013.01); *G21F 9/301* (2013.01); *G21F 9/30* (2013.01); *Y10S 588/901* (2013.01)
USPC ..... 588/14; 588/15; 588/901

(58) Field of Classification Search
USPC ..... 588/14, 15, 10, 11, 252, 901
See application file for complete search history.

(56) References Cited

FOREIGN PATENT DOCUMENTS

| | | | |
|---|---|---|---|
| JP | 2000-131495 | A | 5/2000 |
| JP | 2005-114620 | A | 4/2005 |
| KR | 10-0822862 | B1 | 4/2008 |
| KR | 10-1016223 | B1 | 2/2011 |

*Primary Examiner* — Edward Johnson
(74) *Attorney, Agent, or Firm* — Rabin & Berdo, P.C.

(57) ABSTRACT

Disclosed herein is a method of treating radioactive metal waste using melt decontamination, wherein radioactive metal waste, which is generated from nuclear fuel processing facilities or nuclear fuel production facilities, and which cannot be easily treated by surface decontamination because it has a complicated geometric shape, and the surface contamination of which cannot be measured, can be treated by melt decontamination. The method is advantageous in that radioactive metal waste, which cannot be treated by conventional surface decontamination, can be treated, so that radioactive metal waste can be recycled, thereby obtaining economic profits, and further in that a large storage space necessary for cutting and then storing radioactive metal waste is not required, and in that excessive manpower and cost are not required.

7 Claims, 5 Drawing Sheets

METHOD OF TREATING RADIOACTIVE METAL WASTE USING MELT DECONTAMINATION

BACKGROUND OF THE INVENTION

1. Technical Field

The present invention relates to a method of treating radioactive metal waste using melt decontamination, and, more particularly, to a method of treating radioactive metal waste using melt decontamination, wherein radioactive metal waste, which is generated from nuclear fuel processing facilities or nuclear fuel production facilities, which cannot be easily treated by surface decontamination because it has a complicated geometric shape, and the surface contamination of which cannot be measured, can be treated by melt decontamination.

2. Description of the Related Art

Generally, there are various types of radioactive waste generated from nuclear power plants, nuclear research institutes and the like, such as metals, concretes, contaminated oil and the like occurring when maintaining and dismantling nuclear facilities, and a large amount of this waste is generated.

Among the various types of radioactive waste, the cost for reprocessing or recycling radioactive metal waste is far lower than the cost for producing a product using new natural resources. For this reason, when radioactive metal waste is discarded and not recycled, there may be a great loss in terms of environmental protection and economic efficiency.

Radioactively-contaminated metal waste may be classified into corrosion products included in a primary cooling medium of a nuclear reactor and radiation products produced by the irradiation of neutrons during the operation of a nuclear reactor. Radioactive contaminants adhering to the surface of a metal can be removed by chemical and mechanical decontamination.

However, radiation products are problematic in that they cannot be removed just by surface decontamination because they are distributed even in the metal matrix, and in that their surface contamination cannot be measured because metal products having a complicated geometric shape, such as bolts or nuts, are difficult to treat using surface decontamination and they have a planar area smaller than the effective area of a measuring instrument.

Melt decontamination is advantageous in that the volume of radioactive metal waste is reduced, which well accords with the management target required for the final disposal of radioactive waste, and in that radioactive waste can be safely treated as well as recycled.

Meanwhile, conventional surface decontamination for treating radioactive metal waste is problematic in that metal contaminants having a complicated geometric shape cannot be removed, and in that contaminants distributed in the matrix of metal as well as on the surface of metal cannot be removed. As conventional methods of treating radioactive metal waste, Korean Patent registration No. 10-0822862 discloses a decontamination system for collectively treating radioactive metal waste and a decontamination method using the same, and Korean Unexamined Patent Publication No. 10-2008-0026577 discloses a system for treating middle and low level radioactive waste.

SUMMARY OF THE INVENTION

Accordingly, the present invention has been devised to solve the above-mentioned problems, and an object of the present invention is to provide a method of treating radioactive metal waste using melt decontamination, wherein radioactive metal waste having a complicated geometric shape, which cannot be treated by surface decontamination, can be treated by melt decontamination.

Another object of the present invention is to provide a method of treating radioactive metal waste using melt decontamination, wherein, prior to melt decontamination, radioactive metal waste is classified according to the generation source, material quality and the like thereof, and then surface decontamination is carried out as a pretreatment step according to the level of radioactivity, thereby improving the quality of a finally-produced ingot.

In order to accomplish the above objects, an aspect of the present invention provides a method of treating radioactive metal waste generated from nuclear fuel processing facilities or nuclear fuel production facilities using melt decontamination, including the steps of: selecting radioactive metal waste according to the shape of metal (S10); classifying the selected radioactive metal waste according to the generation source and material quality thereof (S20); surface-decontaminating the classified radioactive metal waste according to the radioactivity level thereof (S30); charging the surface-decontaminated radioactive metal waste in a melting furnace (S40); melting the charged radioactive metal waste to form a molten solution and then introducing an impurity remover containing $SiO_2$ into the molten solution to form slag (S50); removing the slag from the molten solution to obtain an ingot (S60); and forming an ingot obtained by removing the slag from the molten solution (S70).

The method may further include the steps of: collecting samples of the ingot (S80); and measuring the contamination of the samples (S90).

In step S20, the radioactive metal waste may be classified according to the level of concentration of nuclear fuel in a light-water reactor or a heavy-water reactor, which are the generation sources of the radioactive metal waste.

In step S30, the surface decontamination of the radioactive metal waste may be conducted by at least one selected from chemical decontamination, electropolishing decontamination, sand-polishing decontamination, and hand-polishing decontamination.

In step S10, a recarburizer or ferrosilicon may be added as a melting agent.

In step S70, a deoxidizer may be added as a melting agent.

Another aspect of the present invention provides an ingot, formed using the melt-decontaminated radioactive metal waste treated by the method.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
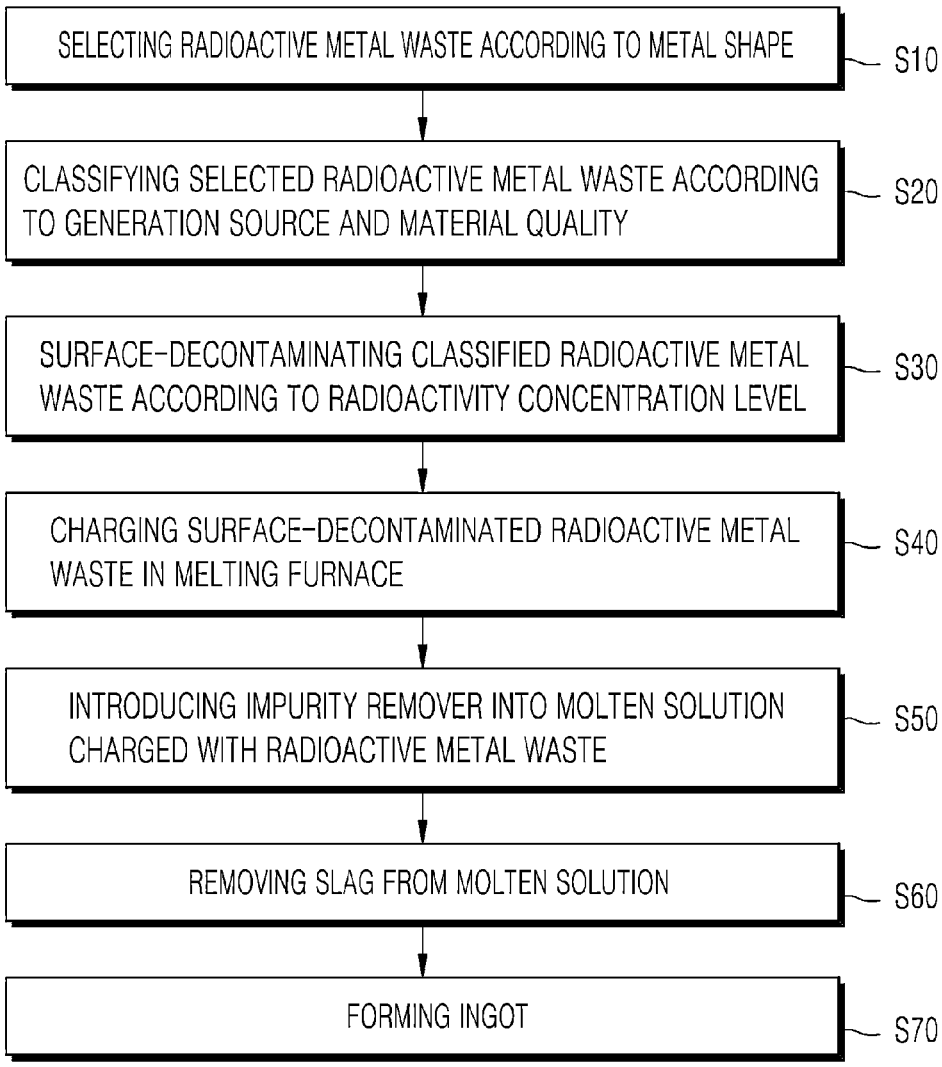
FIG. 1 is a flowchart showing a process of treating radioactive metal waste using melt decontamination according to the present invention.

Hereinafter, preferred embodiments of the present invention will be described in detail with reference to the attached drawings. Reference now should be made to the drawings, in which the same reference numerals are used throughout the different drawings to designate the same or similar components. Further, in the description of the present invention, when it is determined that the detailed description of the related art would obscure the gist of the present invention, such a description will be omitted.

The present invention provides a method of treating radioactive metal waste generated from nuclear fuel processing facilities or nuclear fuel production facilities using melt decontamination. The method broadly includes the steps of: selecting and classifying radioactive metal waste according to the shape, generation source and material quality thereof (S10 and S20); surface-decontaminating the selected and classified radioactive metal waste according to the radioactivity level thereof (S30); melt-decontaminating the surface-decontaminated radioactive metal waste (S40 to S60); and forming an ingot obtained by melt-decontaminating the surface-decontaminated radioactive metal waste (S70).

As shown in FIG. 1, the method of treating radioactive metal waste using melt decontamination according to the present invention includes the steps of: (1) selecting radioactive metal waste according to the shape of metal (S10); (2) classifying the selected radioactive metal waste according to the generation source and material quality thereof (S20); (3) surface-decontaminating the classified radioactive metal waste according to the radioactivity level thereof (S30); (4) charging the surface-decontaminated radioactive metal waste in a melting furnace (S40); (5) melting the charged radioactive metal waste to form a molten solution and then introducing an impurity remover containing $SiO_2$ into the molten solution to form slag (S50); (6) removing the slag from the molten solution to obtain an ingot (S60); and (7) forming an ingot obtained by removing the slag from the molten solution (S70).

In step S10, radioactive metal waste is selected according to the shape of the metal; and, in step S10, the selected radioactive metal waste is classified according to the generation source and material quality thereof.

Concretely, in step S10, among radioactive metal waste, radioactive metal waste which can be surface-decontaminated, that is, flat radioactive metal waste having a simple and smooth geometric shape such as filter frames, waste drums and the like; and radioactive metal waste, such as nuts, bolts and the like, which cannot be easily surface-decontaminated by conventional methods because they have a complicated geometric shape, and the surface contamination of which cannot be measured because they has a planar area smaller than the effective area of a measuring instrument are selected. This selected radioactive metal waste is subject to melt decontamination.

In step S20, the radioactive metal waste selected in the step S10 is classified according to the generation source and material quality thereof, and, if necessary, the classified radioactive metal waste may be suitably decontaminated by physical and chemical methods according to the radioactivity concentration level thereof, thereby allowing the finally-produced ingot to meet the standard value of allowance required to dispose of radioactive waste. Meanwhile, the generation source of radioactive metal waste may differ depending on the concentration of nuclear fuel. For example, radioactive metal waste may be generated from a light-water reactor or a heavy-water reactor.

Further, in step 20, radioactive metal waste is classified according to the material quality thereof. The reason for this is that, since the radioactive metal waste to be treated include various metals, such as iron (Fe), stainless steel, carbon steel, copper (Cu), lead (Pb and the like, when these are all melted together without being classified, the quality of the finally-produced ingot deteriorates to degrade the economic value thereof, and it is difficult to obtain an ingot having a desired shape due to fluidity differences occurring during melt decontamination. Therefore, prior to melt decontamination, when the radioactive metal waste to be treated is classified according to the material quality thereof and then only the classified radioactive metal waste having the same material quality is melt-decontaminated to produce an ingot, resources can be efficiently recycled as well as economic values and workability can be improved.

In the step S30, the radioactive metal waste selected and classified in the steps S10 and S20 is suitably surface-decontaminated according to the generation source thereof, that is, the radioactivity level, in a pretreatment process. The surface decontamination of the radioactive metal waste may be conducted by chemical decontamination, electropolishing decontamination, sand-polishing decontamination, hand-polishing decontamination or the like. Owing to this pretreatment process, the finally-produced ingot can meet the standard value of allowance required to dispose of radioactive waste.

In step S40, the surface-decontaminated radioactive metal waste in charged in a melting furnace; in step S50, the charged radioactive metal waste is melted to form a molten solution, and then an impurity remover containing $SiO_2$ is introduced into the molten solution to form slag; and in step S60, the slag is removed from the molten solution to obtain a molten product. These steps S40, S50 and S60 correspond to a process of melt-decontaminating the radioactive metal waste selected, classified and surface-decontaminated (pretreated) in the steps S10 to S30.

In detail, in step S40, the radioactive metal waste, which have been selected (S10), classified (S20) and then surface-decontaminated (pretreated) (S30), is charged in a melting furnace. In this case, the melting furnace used to conduct melt decontamination is a high-frequency radiation type induction heating furnace, and can melt-contaminate metals at a rate of 200~300 kg per batch. This induction heating furnace is configured such that the induction current occurring when electricity flows around the metal to be heated forms a circuit in the metal to heat the metal. This induction heating furnace is advantageous in that a molten solution is stirred in the furnace, so that the ingot produced by melting becomes homogeneous, with the result that the radioactivity of metal waste can be easily measured. Further, this induction heating furnace is advantageous in that melting is easy to carry out compared to other furnaces, and metal loss is small to such a degree that it is negligible, and in that it can be preferably used to treat radioactive metal waste using melt decontamination because it is characterized in terms of the improvement of the quality of the finally-produced ingot, the ease of maintaining the purity of the finally-produced ingot, the ease of controlling heating time and temperature, high stability and the like.

Meanwhile, in order to assure the flowability of a molten solution in the step of charging the surface-decontaminated radioactive metal waste in the melting furnace (S40), a ferro-silicon-based additive including Si and Fe as main components may be charged in the melting furnace together with the radioactive metal waste.

In step S50, the radioactive metal waste charged in the melting furnace is melted to form a molten solution, and then an impurity remover containing $SiO_2$ is introduced into the molten solution to form slag. Most uranium materials move into the slag, and some of them are collected in a filter connected to melting equipment in the form of dust. Meanwhile, since dust collecting equipment connected with the melting furnace is directly connected to a gas control system in a nuclear fuel processing plant, the discharge of dust generated by melt decontamination to the outside of the dust collecting equipment must be blocked.

In step S60, the slag generated by the introduction of the impurity remover and containing the uranium material is removed from the molten solution to obtain an ingot. In step S70, an ingot is obtained by removing the slag from the molten solution is formed.

Meanwhile, in step S70 of forming the ingot, a deoxidizer containing $Al_2O_3$ as a main component may be added such that the formation of bubbles due to oxidation is prevented to improve the quality of the finally-produced ingot, that is, the surface of the ingot is made smooth so that the degree of contamination thereof can be easily measured.

Figure 2:
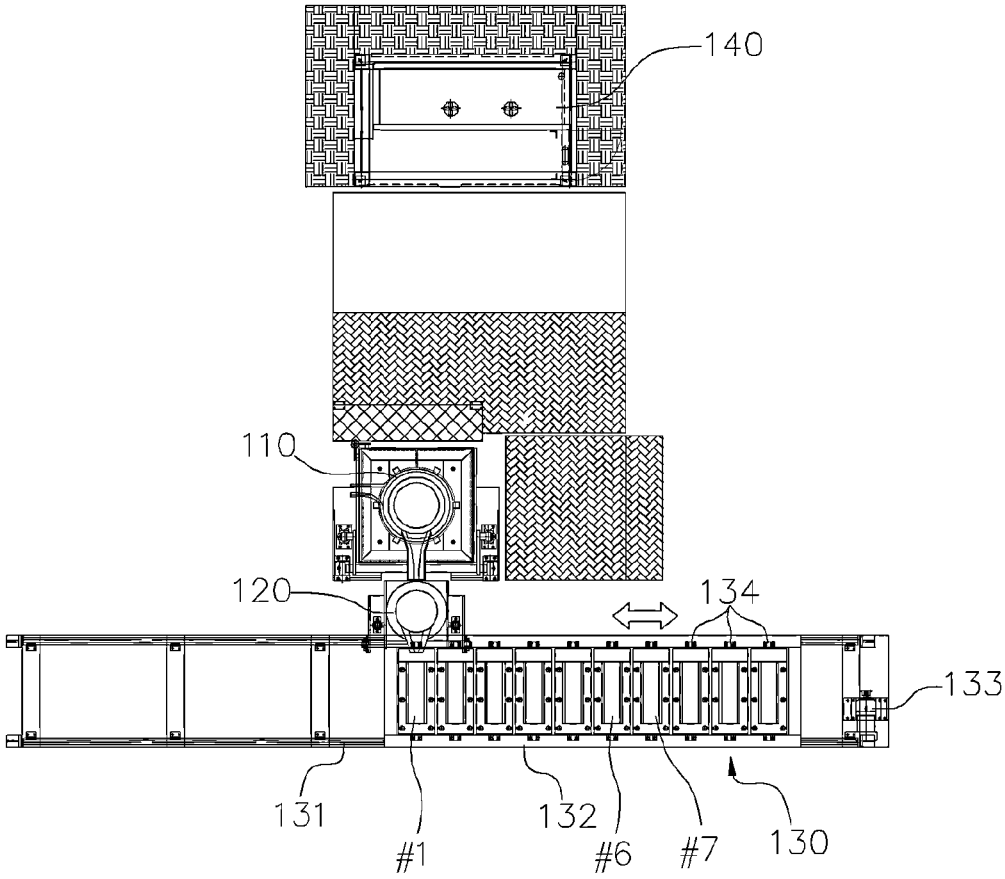
FIG. 2 is a plan view showing a melt decontamination apparatus for treating radioactive metal waste according to the present invention.
Figure 3:
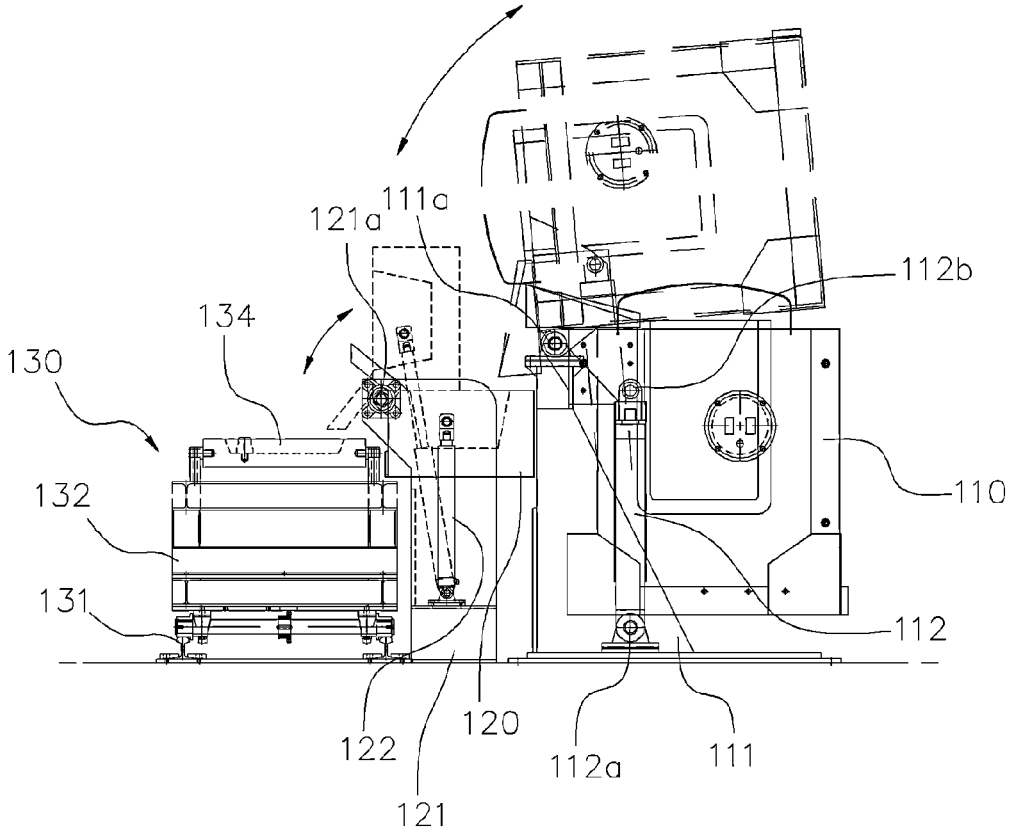
FIG. 3 is a side view showing a melt decontamination apparatus for treating radioactive metal waste according to the present invention.
Figure 4:
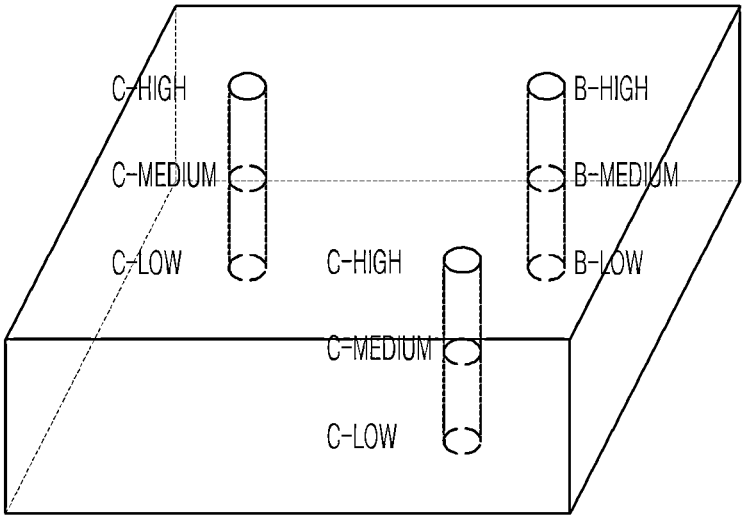
FIG. 4 is a view showing sample collection portions of the ingot manufactured by the process of treating radioactive metal waste using melt decontamination according to the present invention.

The process of forming an ingot using melt decontamination in steps S40 to S70 will be described as follows with reference to FIGS. 2 and 4. Referring to FIGS. 2 and 3, The melt contamination apparatus used to melt-contaminate radioactive metal waste in the present invention includes a melting furnace 110 for melting metal waste using induction current, a ladle 120 for injecting a molten solution containing no slag and formed in the melting furnace 110 into a mold 134, and a mold unit for forming an ingot using the molten product injected by the ladle 120.

As shown in FIG. 2, the melting furnace 110 includes an induction coil at the outer circumference thereof such that induction current flows through the induction coil, and is provided with a high-frequency output part 140, so that high-frequency current is supplied to the induction coil. The ladle 120 is used to inject a molten product containing no slag and formed in the melting furnace 110 into a mold 134. When the ladle 120 is tilted, the molten product is injected into the mold 134, thus forming an ingot.

The mold unit 130 includes a trolley 132 moving along a rail 131, a motor 133 for driving the trolley 132, and a plurality of molds 134 provided on the trolley 132.

The trolley 132 is connected with the motor 133 by a chain. Therefore, when the motor 133 drives the trolley 132 by normal rotation or reverse rotation, the trolley can horizontally move along the rail 131.

The trolley 132 is provided thereon with the plurality of molds 134. Each of the molds 134 may be reversibly provided on the trolley 132. The molten solution injected into the mold 134 is cooled to be formed into a solid ingot, and then the mold 134 is inverted to separate the solid ingot from the ingot 132.

Although not shown, the melt decontamination apparatus may be provided with a dust collector for collecting the gas and dust that occurs during a melting process.

FIG. 3 is a side view showing the main constituents of the melt decontamination apparatus according to the present invention. Here, the melting furnace 110 is constructed such that its upper end can be rotated by a first rotation shaft 111*a* of a first support 111 strongly fixed on the ground. Further, a cylinder 112 is constructed such that its lower end is rotatably provided on the ground by a second rotation shaft 112*a* and its upper end is rotatably connected with the melting furnace 110 by a third rotation shaft 112*b*.

Since the cylinder 112 is retractably moved in a length direction by oil pressure or air pressure, the melting furnace 110 can be rotated based on the first rotation shaft 111*a* depending on the degree of telescopic motion of the cylinder 112, and thus the molten solution in the melting furnace 110 can be poured and transferred into the ladle 120.

The ladle 120 provided adjacent to the melting furnace 110 is constructed such that its upper end can be rotated by a fourth rotation shaft 121*a* of a second support 121 strongly fixed on the ground. A second cylinder 122, similarly to the cylinder 112 provided at the melting furnace 110, is provided at the ladle 120. Therefore, the ladle 120 can be rotated based on the fourth rotation shaft 121*a* depending on the degree of telescopic motion of the second cylinder 122, and thus the molten solution in the ladle 120 can be poured and transferred into the mold 134.

Hereinafter, the present invention will be described in more detail with reference to the following Examples. These Examples are set forth to illustrate the present invention, and it is obvious to those skilled in the art that the scope of the present invention is not limited thereto.

Example 1

Preparations for Test (1) Test Summary

In order to estimate the material balance attributable to the melt decontamination of the present invention, 1 kg of $UO_2$ having a concentration of 4.65 w/o was charged in a non-contaminated metal material, and one sample was extracted from a molten solution and then the gamma nuclide analysis of the one sample was conducted using ICP-MS (inductively coupled plasma mass spectroscopy) and a high-purity germanium (HPGe) detector. Then, two ingots were selected from the produced ingots, samples were extracted from nine portions per single ingot, and then the uranium concentration of each of the samples was analyzed using ICP-MS to prove the homogeneity of the molten solution. Further, gamma nuclide analysis of the slag occurring during the melt decontamination was carried out using a high-purity germanium (HPGe) detector and the ICP-MS analysis thereof were simultaneously conducted to grasp the decontamination coefficient and estimate the material balance.

(2) Determination of Charged Uranium

Technologies for melt-decontaminating metal waste containing radioactive materials have been widely researched inside and outside of the country. In particular, when the contamination source thereof is a nuclear fuel material, it was reported that most of the radioactive contamination source is transferred to the slag during melting, and that although the decontamination effect thereof changes depending on the operation conditions, such as the initial contamination conditions, use of a melting agent, the type of a melting furnace and the like, the partition factor (PF) is about 1000. In this case, when the PF is applied, the amount of uranium transferred to an ingot is about 1/1000 of the total amount thereof. Therefore, when 1000 g of uranium is introduced, the concentration of uranium in the ingot is about 4 ppm, which meets the disposal limit value and sufficiently meets the minimum detectable level (MDL) of ICP-MS.

Therefore, in this test, 1 kg of $UO_2$ powder (concentration: 4.65 w/o) was charged, the uranium analysis for estimating the homogeneity in the molten solution was conducted using ICP-MS, and gamma nuclide analysis of the same sample was conducted using a high-purity germanium (HPGe) detector.

Example 2

Performance of Melt Decontamination

The melt decontamination test was conducted for about 3 hours according to the following processes. Further, the work of separating the ingot from a mold was conducted the day after the melt decontamination test because this work must be conducted in a state in which the ingot has sufficiently cooled. The melt decontamination process according to the present invention is shown in FIG. 1, and the melt decontamination process according to Example 1 will be described in detail as follows.

In the process of selecting metal waste, the metal waste generated from nuclear fuel processing facilities is considered to be a material contaminated by radioactive material. Here, flat metal waste having a simple and smooth geometric shape such as filter frames, waste drums and the like; and metal waste, such as nuts, bolts and the like, which cannot be easily surface-decontaminated by conventional methods because they have a complicated geometric shape, and the surface contamination of which cannot be measured because they have a plane area smaller than the effective area of a measuring instrument are selected. This selected metal waste is subject to melt decontamination.

Since the metal waste selected according to the shape thereof include various metals, such as iron (Fe), stainless steel, carbon steel, copper (Cu), lead (Pb) and the like, when they are all melted together without being classified, the quality of the recycled ingot deteriorates, and it is difficult to obtain an ingot having the desired shape due to the fluidity differences that occur during melt decontamination, so that the selected metal waste was classified according to the material quality thereof, and then only the classified metal waste having the same material quality were melt-decontaminated.

Subsequently, the classified metal waste was suitably surface-decontaminated according to the radioactivity level, and was then pretreated to remove particles attached thereto and paints therefrom.

The classified carbon steel-based metal waste and 500 g of uranium powder having a concentration of 4.65 w/o was charged into a melting furnace and then primarily heated for 1 hour to form a molten solution. Thereafter, 500 g of uranium and metal waste was additionally charged into the melting furnace until the volume of the molten solution became 80% or more of the capacity of the melting furnace.

When the temperature of the molten solution increased, an impurity remover (SLAX) was added to the molten solution to remove slag containing uranium, rust and the like. In this case, when the level of the molten solution in the melting furnace dropped because of the slag being removed, metal waste was additionally charged into the melting furnace, an impurity remover ($SiO_2$-based SLAX) was continuously added to remove uranium and impurities, and then the slag collected in the upper portion of the melting furnace was repeatedly removed. When the condition for forming an ingot was satisfied, the meting furnace was tilted to inject the molten solution into the ladle, and then the ladle was tilted to inject the molten solution into the mold. At this time, a deoxidizer was introduced into the ladle. Since molten metal absorbs oxygen and other gases from the atmosphere, when it is solidified to be formed into a casting, gas holes are formed in the casting, and oxides remain in the casting, so that the casting becomes brittle. Therefore, when the deoxidizer is added, the metal combines with oxygen in the molten solution to form metal oxide, and the metal oxide is formed into slag. This slag is removed from the molten solution, and then the molten solution is injected into the mold, thereby forming a flat and smooth ingot.

Example 3

Sample Extraction

Samples were extracted from the ingot and slag produced in the process of conducting melt decontamination according to Example 2 of the present invention, and the extraction of the samples was carried out according to ASTM-1806.

The results of analyzing the extracted samples are given in Table 1. Meanwhile, among ten ingots melt-decontaminated according to Example 1, the ingots fabricated in the first mold, the sixth mold and the seventh mold are represented by #1, #6 and #7, respectively (refer to FIG. 2).

TABLE 1

| Classifications | Sample extraction method | Gamma nuclide analysis | ICP-MS analysis | Remarks |
|---|---|---|---|---|
| #3 ingot (23.6 kg) | milling | 1000 mL | 1 EA | |
| #6 ingot (36.6 kg) | drilling | | 3 × 3 EA | |
| #7 ingot (22.4 kg) | drilling | | 3 × 3 EA | |
| Molten solution (6.4 kg) | milling | 1000 mL | 1 EA | crucible type |
| Slag (—) | — | | 3 EA | |
| Sum | | about 2000 mL | 23 EA | |

Figure 5:
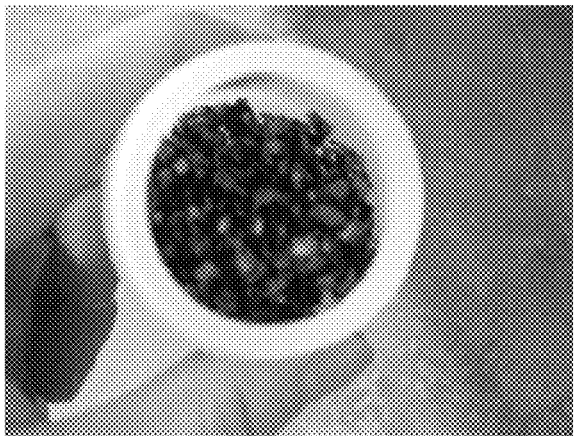
FIG. 5 is a photograph showing ingot samples collected by milling.
Figure 6:
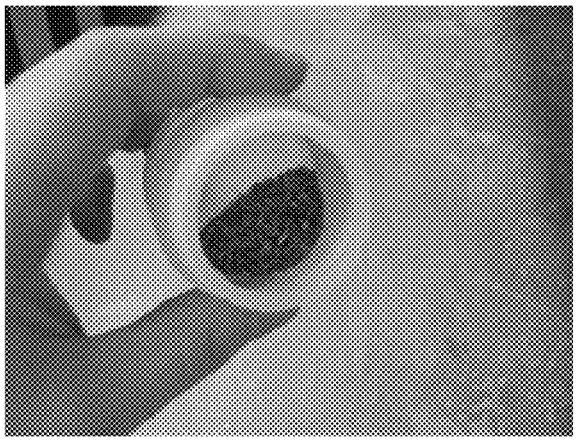
FIG. 6 is a photograph showing ingot samples collected by drilling.

As given in Table 1 above, among the ten ingots produced according to Example 2, three ingots were selected (refer to FIG. 2), and nine samples were extracted from each of the three ingots (refer to FIG. 4), and samples obtained by milling or drilling are shown in FIGS. 5 and 6.

Test Example 1

Results of Analysis of Ingot and Slag (HPGe, ICP-MS)

The ingots, molten solution samples and slag obtained in Example 3 were analyzed using ICP-MS and HPGe, and the results thereof are as follows.

TABLE 2

Results of analysis of molten solution and the third ingot (#3) (ICP-MS/MPGe)

| Analysis method | | Radioactivity concentration (Bq/g) U-235 | U-238 | Total | Remarks |
|---|---|---|---|---|---|
| #3 ingot | ICP-MS | 0.0007 | 0.0031 | $2.12 \times 10^{-2}$ | |
| | HPGe | $1.26 \times 10^{-3}$ | — | $2.813 \times 10^{-2}$ | 4.65 w/o |
| Molten solution | ICP-MS | 0.0011 | 0.0036 | $2.50 \times 10^{-2}$ | |
| | HPGe | $9.18 \times 10^{-4}$ | — | $2.045 \times 10^{-2}$ | 4.65 w/o |

TABLE 3

Results of analysis of the sixth ingot (#6) (ICP-MS)

| No. | Position | Radioactivity concentration (Bq/g) U-235 | U-238 | Total | Remarks |
|---|---|---|---|---|---|
| 1 | A-upper | 0.0008 | 0.0025 | 0.0175 | |
| 2 | A-middle | 0.0008 | 0.0026 | 0.0185 | |
| 3 | A-lower | 0.0009 | 0.0026 | 0.0185 | |
| 4 | B-upper | 0.0008 | 0.0022 | 0.0158 | |
| 5 | B-middle | 0.0008 | 0.0023 | 0.0162 | |
| 6 | B-lower | 0.0008 | 0.0024 | 0.0167 | |
| 7 | C-upper | 0.0008 | 0.0030 | 0.0209 | |
| 8 | C-middle | 0.0007 | 0.0021 | 0.0145 | |
| 9 | C-lower | 0.0008 | 0.0021 | 0.0150 | |
| Average | | — | | 0.017011 | |
| Standard deviation | | — | | 0.002056 | |

TABLE 4

Results of analysis of the seventh ingot (#7) (ICP-MS)

| No. | Position | Radioactivity concentration (Bq/g) U-235 | U-238 | Total | Remarks |
|---|---|---|---|---|---|
| 1 | A-upper | 0.0010 | 0.0026 | 0.0188 | |
| 2 | A-middle | 0.0009 | 0.0024 | 0.0170 | |
| 3 | A-lower | 0.0010 | 0.0024 | 0.0171 | |
| 4 | B-upper | 0.0007 | 0.0027 | 0.0187 | |
| 5 | B-middle | 0.0007 | 0.0030 | 0.0209 | |
| 6 | B-lower | 0.0008 | 0.0040 | 0.0276 | |
| 7 | C-upper | 0.0006 | 0.0025 | 0.0176 | |
| 8 | C-middle | 0.0005 | 0.0021 | 0.0148 | |
| 9 | C-lower | 0.0007 | 0.0027 | 0.0166 | |
| Average | | — | | 0.018733 | |
| Standard deviation | | — | | 0.003716 | |

TABLE 5

Results of analysis of slag (ICP-MS/HPGe)

| Analysis method | | Radioactivity concentration (Bq/g) U-235 | U-238 | Total | Remarks |
|---|---|---|---|---|---|
| Initial stage (01) | ICP-MS | 240.0 | 701.9 | 4,941 | |
| | HPGe | 130.3 | — | 2,903 | |
| Middle stage (02) | ICP-MS | 3.84 | 12.3 | 86.4 | |
| | HPGe | 12.06 | — | 286.8 | |
| Last stage (03) | ICP-MS | 21.36 | 70.25 | 491.8 | |
| | HPGe | 41.88 | — | 932.2 | |

From Tables 2 to 5 above, it can be ascertained that the initial contamination degree was $7.3\times10^7$ Bq, and, as the result of analysis of uranium transferred to ingot, the initial degree of contamination was about 6,900 Bq, so the PF was 10,588, and the decontamination coefficient was similar, with the result that very excellent decontamination effects were exhibited.

The concentrations of radioactivity in the ingot were measured using ICP-MS. As a result, there was a concentration deviation of 0.0145~0.0250 Bq/g, but the corresponding radioactivity level was less than 1/10 of that of nature (0.0250 Bq/g is about 0.3 ppm, and the concentration of uranium in the natural soil is about 3~5 ppm), that is, the corresponding radioactivity level was very low. Therefore, considering statistical error, it is determined that the corresponding result values are good enough to prove the homogeneity of the molten solution at the time of melt decontamination.

Particularly, the highest concentration of radioactivity in the ingot was only 5% or less of 0.497 Bq/g, which is the limiting value for clearance. Therefore, it is determined that the decontamination effect attributable to melting is very excellent.

Test Example 2

Determination of Nuclide Partitioning Factors

In order to determine the effects of the melt decontamination according to the present invention, partitioning factors were estimated based on the data of Test Example 1 as follows.

In the work of melting the metal (steel) contaminated by a radioactive material (Uranium) presented in NUREG-1640, the nuclide partitioning factors of uranium transferred to metal, dust, slag, and volatile matter are given in Table 6 below.

TABLE 6

Nuclide partitioning factors of uranium in melting and steelmaking (NUREG-1640)

| | Nuclide partitioning factor Metal | Dust | Slag | Volatile matter |
|---|---|---|---|---|
| Steelmaking | 0 | 2.5~7.5 | 92.5~97.5 | 0 |
| Cast iron melting | 0 | 2.5~7.5 | 92.5~97.5 | 0 |

As given in Table 6 above, in the case of melt decontamination of metal contaminated by uranium, it is mentioned in NUREG-1640 that the transfer ratio of uranium to an ingot is 0% but, really, it is determined that an infinitesimal quantity of uranium be transferred to metal.

Since radioactivity concentration of the ingot fabricated in Example 2 is homogeneous, the total amount of radioactivity thereof can be estimated by sampling a part of the ingot. However, since the radioactivity concentration of slag differs greatly depending on the position of the extracted sample even when it is analyzed by a sampling method, it is difficult to analyze the radioactivity of the overall slag using the extracted sample. Further, even in the case of dust, since only the dust occurring during the corresponding melting experiment cannot be independently collected and quantitated due to the characteristics of equipment, it is difficult to determine the amount of uranium that was transferred to the dust. Meanwhile, nuclides are known to be nonvolatile, and the operation temperature of a melting furnace is lower than the melting point of uranium oxide due to the characteristics of the melting furnace, so that it is hardly possible for uranium nuclide to volatilize and thus spread in the air even when melt decontamination is conducted.

Therefore, the sum of the amount of uranium transferred to slag and the amount of uranium transferred to dust was calculated by subtracting the amount of radioactivity in the analyzed ingot from the amount of radioactivity before melt decontamination. Further, when it was required to determine the amount of radioactivity transferred to the slag and the dust, the partitioning factors presented in NUREG-1640 were applied. In this case, the maximum value of the partitioning factor of the slag was 97.5, the maximum value of the partitioning factor of dust was 7.5, and the sum thereof was 105.

TABLE 7

Element and mass partitioning factors in melt decontamination experiment using the partitioning factors presented in NUREG-1640

| | | Before melt decontamination | After melt decontamination | | | | |
|---|---|---|---|---|---|---|---|
| | | | Ingot | Slag* | Dust* | volatile matter | Sum |
| Element | Radioactivity (Bq) | $7.31 \times 10^7$ | 6,900 | $7.13 \times 10^7$ | $5.48 \times 10^6$ | 0 | $7.68 \times 10^7$ |
| | Partitioning factor (%) | 100 | $9.44 \times 10^{-3}$ | 97.5 | 7.5 | 0 | 105 |
| Mass | Mass (kg) | 250 (275.4)** | 250 | 22.9 | 2.5 | 0 | 275.4 |
| | Partitioning factor (%) | (100)** | 90.78 | 8.32 | 0.91 | 0 | 100 |
| Radioactivity concentration (Bq/g) | | 292.40 | 0.0276 | 3,113 | 2,190 | 0 | — |

*Radioactivity and nonradioactivity of slag and dust are induced by partitioning factor of NUREG-1640.
**Amounts of metal wastes + additives are designated in parentheses.

As given in Table 7, it can be ascertained that, when radioactive metal waste generated from nuclear fuel processing facilities were treated by melt decontamination, the uranium removal effect is very excellent.

The analyzed values of the concentration of radioactivity given in Table 7 above and the actually-measured values thereof were estimated by applying the minimum values of the partitioning factors presented in NUREG-1640. Therefore, it is predicted that the actual concentration and amount of radioactivity will be lower.

As described above, according to the present invention, there is a provided a method of treating radioactive metal waste using melt decontamination, wherein radioactive metal waste, which is generated from nuclear fuel processing facilities or nuclear fuel production facilities, which cannot be easily treated by surface decontamination because it has a complicated geometric shape and its surface contamination cannot be measured, can be treated by melt decontamination. The method is advantageous in that radioactive metal waste, which cannot be treated by conventional surface decontamination, can be treated, so that radioactive metal waste can be recycled, thereby obtaining economic profits, and further in that a large storage space necessary for cutting and then storing radioactive metal waste is not required, and in that excessive manpower and cost are not required.

Although the embodiments of the present invention have been disclosed for illustrative purposes, it will be appreciated that the present invention is not limited thereto, and those skilled in the art will appreciate that various modifications, additions and substitutions are possible, without departing from the scope and spirit of the invention. Accordingly, any and all modifications, concentrations or equivalent arrangements should be considered to be within the scope of the invention, and the detailed scope of the invention will be disclosed by the accompanying claims.

What is claimed is:

1. A method of treating radioactive metal waste generated from nuclear fuel processing facilities or nuclear fuel production facilities using melt decontamination, comprising the steps of:

selecting radioactive metal waste according to the shape of metal (S10);

classifying the selected radioactive metal waste according to a generation source and a material quality thereof (S20);

surface-decontaminating the classified radioactive metal waste according to a radioactivity level thereof (S30);

charging the surface-decontaminated radioactive metal waste in a melting furnace (S40);

melting the charged radioactive metal waste to form a molten solution and then introducing an impurity remover containing $SiO_2$ into the molten solution to form slag (S50);

removing the slag from the molten solution to obtain an ingot (S60); and forming an ingot obtained by removing the slag from the molten solution (S70).

2. The method of claim 1, further comprising the steps of:

collecting samples of the ingot (S80); and measuring contamination of the samples (S90).

3. The method of claim 1, wherein, in the step S20, the radioactive metal waste is classified according to a concentration of nuclear fuel in a light-water reactor or a heavy-water reactor, which are the generation sources of the radioactive metal waste.

4. The method of claim 1, wherein, in the step S30, the surface decontamination of the radioactive metal waste is conducted by at least one selected from chemical decontamination, electropolishing decontamination, sand-polishing decontamination, and hand-polishing decontamination.

5. The method of claim 1, wherein, in the step S10, a recarburizer or ferrosilicon is added as a melting agent.

6. The method of claim 1, wherein, in the step S70, a deoxidizer is added as a melting agent.

7. An ingot, formed using the melt-decontaminated radioactive metal waste treated by the method of claim 1.

* * * * *